US007718017B2

(12) United States Patent
Breton et al.

(10) Patent No.: US 7,718,017 B2
(45) Date of Patent: May 18, 2010

(54) METHOD FOR THE MONOBLOC SIZING FOR THE TEMPERING CASINGS AND DEVICE FOR IMPLEMENTING THE METHOD

(75) Inventors: Michel Breton, Rieux (FR); Patrice Rene Sagne, Vineuil Saint-Firmin (FR)

(73) Assignee: SNECMA, Paris (FR)

( * ) Notice: Subject to any disclaimer, the term of this patent is extended or adjusted under 35 U.S.C. 154(b) by 342 days.

(21) Appl. No.: 11/691,122

(22) Filed: Mar. 26, 2007

(65) Prior Publication Data

US 2007/0221299 A1 Sep. 27, 2007

(30) Foreign Application Priority Data

Mar. 27, 2006 (FR) ..... 06 51039

(51) Int. Cl.
*C21D 8/00* (2006.01)

(52) U.S. Cl. ..... 148/646

(58) Field of Classification Search ..... None
See application file for complete search history.

(56) References Cited

U.S. PATENT DOCUMENTS

| | | | | |
|---|---|---|---|---|
| 4,444,604 | A | 4/1984 | Martin | |
| 4,504,554 | A * | 3/1985 | Yoshioka et al. | 428/683 |
| 6,074,601 | A | 6/2000 | Nakamura | |
| 2003/0231975 | A1 * | 12/2003 | Braillard et al. | 419/32 |

FOREIGN PATENT DOCUMENTS

| | | |
|---|---|---|
| EP | 0 553 154 81 | 7/1994 |

OTHER PUBLICATIONS

W. Betz et al, High Temperature Alloys for Gas Turbines and Other Applications Part I (1986).*

Benninghoff H, "Waermebehandlung in Vorrichtungen", NSDOCID, XP002015629, Jan. 1978, pp. 451-454.

H.-W. Zoch, et al., "Verzug und Strangguss—Einfluss des Giessformats beim Fixturhaerten von Waelzlagerstahlringen", HTM Haerterei Technische Mitteilungen, vol. 49, No. 4, XP000459597, Jul. 1, 1994, pp. 245-253.

* cited by examiner

*Primary Examiner*—Roy King
*Assistant Examiner*—Yoshitoshi Takeuchi
(74) *Attorney, Agent, or Firm*—Oblon, Spivak, McClelland, Maier & Neustadt, L.L.P.

(57) ABSTRACT

A method of sizing a cylindrical part following shaping, by plastic deformation, of a metallic material that has maximum structural shrinkage at a maximum-shrinkage temperature between a first temperature and a second temperature, which is lower than the first temperature, is disclosed. The method includes placing the part in a shaft furnace, heating the part to the first temperature, lowering and fitting into the part an internal-sizing tool with an outer diameter greater than an inner diameter of the part at maximum structural shrinkage, transporting the assembly formed by the part and the sizing tool to a tempering vessel, cooling the part to a temperature below said second temperature, and extracting the internal-sizing tool. The method applies to the manufacture of turbo-machine casings.

7 Claims, 5 Drawing Sheets

METHOD FOR THE MONOBLOC SIZING FOR THE TEMPERING CASINGS AND DEVICE FOR IMPLEMENTING THE METHOD

BACKGROUND OF THE INVENTION

The present invention relates to the field of metallurgy and is aimed at the sizing of cylindrical parts formed by rolling.

In the field of turbomachinery, cylindrical parts are made as a single piece in order in particular to form compressor casings or blade retention casings. This type of part, which may be large in size and heavy in weight, is made by rolling a bloom of alloy suited to its end-use. The rolling is followed by a heat treatment employing heat in order to improve its mechanical properties by relaxing the internal stresses caused by the work involved in the plastic deformation of the material. Aside from this treatment, a sizing operation is required because of the tight tolerances on the dimensions, particularly internal dimensions, of this type of part.

DESCRIPTION OF THE PRIOR ART

Currently, prior to the heat treatment step a device known as an expander, provided with appropriate push-rods, generally hydraulically operated, is used to expand the interior surface. However, it is found that the geometry of the part is liable to change further during the heat treatment and a further cold-sizing operation is often needed. It has been proposed for the part to be formed with excess thickness capable of absorbing the change in dimension but such a solution is unsatisfactory, particularly in the case of an aeronautical turbomachine, because of the increase in weight of material involved.

The applicant has set itself the objective of developing a new method for sizing a cylindrical part obtained by the plastic deformation of material that is more economical, reducing the number of operations and developing tooling of a structure that is less complicated and less expensive to produce.

SUMMARY OF THE INVENTION

The invention stems from the observation made regarding certain alloys, including steel alloy Z5CNU17, which have the property of exhibiting maximum structural shrinkage at a temperature lying between the hot heat treatment temperature and ambient temperature. The material, during the cooling phase, contracts down to this temperature then expands when the temperature of the part is returned to ambient temperature.

The method of the invention for sizing a cylindrical part following the shaping, by rolling, of a metallic material that has maximum structural shrinkage at a maximum-shrinkage temperature lying between a first temperature, such as a hot heat treatment temperature, and a second temperature such as ambient temperature, is a method which comprises the following successive steps:

- placing the part in a shaft furnace,
- positioning outside the furnace and in line with the part an internal-sizing apparatus of a diameter greater than that which the part exhibits when it has undergone its maximum structural shrinkage,
- heating the part to a first temperature,
- lowering and fitting into the part an internal-sizing tool of a diameter greater than that exhibited by the part when it has undergone its maximum structural shrinkage,
- transporting the assembly formed by the part and the sizing tool to a tempering vessel,
- cooling the part to a temperature below said second temperature,
- extracting the internal-sizing tool.

Thus, through the method of the invention, this property of the material is put to good use for sizing the part during the tempering phase after heat treatment by the application of heat, thus simplifying the operations involved in treating the part. Furthermore, the sizing tool may be a simple annulus of appropriate outside diameter with no articulated or mechanized parts.

In practice, the part is placed in a furnace and heated to its first temperature, which advantageously is its heat treatment temperature; then, said sizing tool is placed on the part and the assembly is positioned in a tempering tub where the part is cooled to said lower temperature, which tends toward ambient temperature.

However, although the method applies advantageously in combination with the heat treatment and tempering of the part after it has been manufactured by rolling, it can be employed each time the material has a maximum-shrinkage temperature lying between a first temperature and a second temperature, the first being higher than the second.

The invention also relates to a special device allowing for advantageous implementation of the method. This device comprises a dummy bar with a frame provided with articulated radial arms forming supports for the part, a catching means for attaching the dummy bar, the sizing tool being suspended by cables or other equivalent means from said catching means.

According to another characteristic, the catching means for attaching the dummy bar can be moved between a position in which it is secured by a rod to the dummy bar and a position in which the dummy bar is suspended from the catching means by cables or other equivalent means.

BRIEF DESCRIPTION OF THE DRAWINGS

A nonlimiting embodiment of the method of the invention is now described with reference to the drawings in which.

DESCRIPTION OF THE PREFERRED EMBODIMENTS

The method is described by detailing the various phases. The part to be sized may be a turbomachine casing such as an intermediate casing, a compressor casing or a retention casing comprising a cylindrical part formed by plastic deformation of a metallic material such as Z5CNU17 steel. The latter has the property of having maximum structural shrinkage at between 200 and 300° C.

Figure 1:
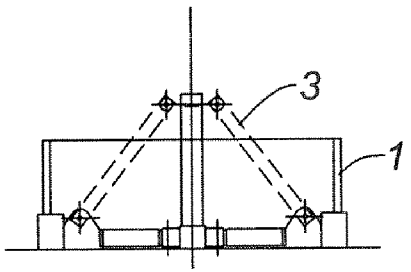
FIGS. 1 to 5 show the various steps in the method of the invention according to a first embodiment.
Figure 2:
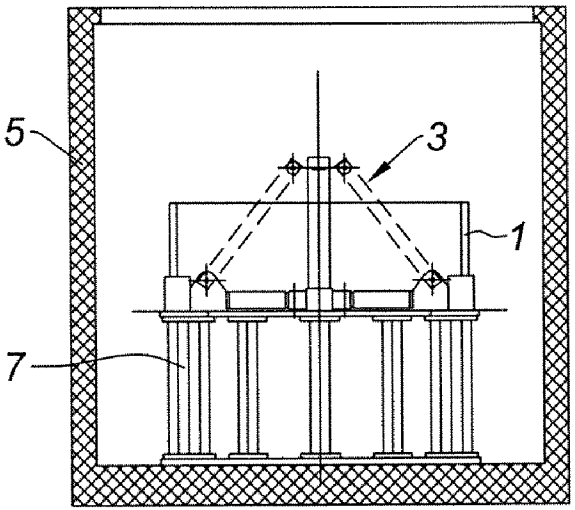
Figure 3:
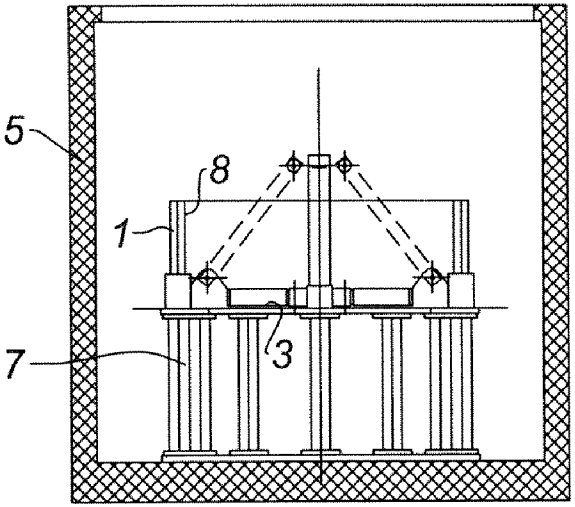

FIGS. 1 to 5 depict the sequence of a first embodiment of the method of the invention. They show the cylindrical part 1, a casing for example, resting vertically by an edge on a support 3 suspended from a cable allowing it to be moved by appropriate lifting gear. FIG. 2 shows the part 1 transported with its support 3, into a pot furnace 5 equipped with a bed 7 on which the part and support assembly has been placed. During the time it spends in the furnace the part is subjected to a heat treatment at a chosen temperature, for example, in the case of a turbomachine casing made of the aforementioned steel, at 1000° C. for a predetermined length of time; the part is then in the expanded state. FIG. 3 shows that a sizing tool 8, also of cylindrical shape, has been placed inside the part. This tool is cold, its exterior profile is identical to the interior profile of the part 1, and its exterior dimensions are slightly greater than those of the interior surface of the part 1 when this part is at the temperature at which it exhibits maximum structural shrinkage.

Figure 4:
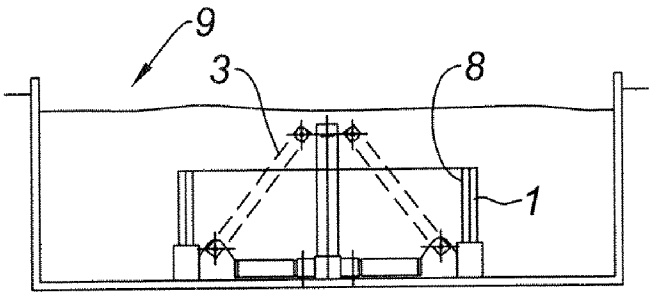
Figure 5:
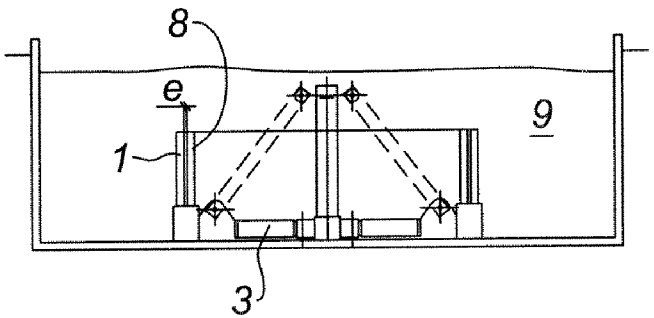
Figure 7:
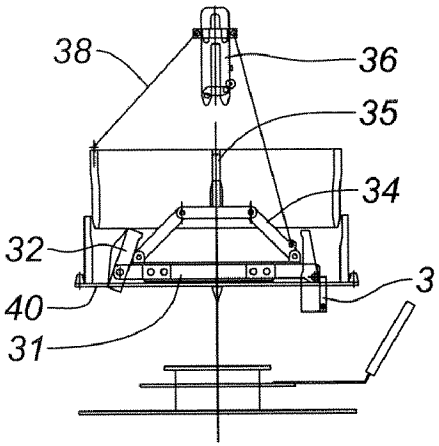
FIGS. 6 to 18 show the various steps in the method according to another particularly advantageous embodiment.

The support is then attached to a cable of lifting and transport gear to move the assembly to a tempering vessel 9 as can be seen in FIG. 4. The vessel is filled with a tempering fluid to bring the temperature at a controlled rate down to ambient temperature. During this process, the part undergoes shrinkage and its compression on the sizing gage 8 is at a maximum when it reaches that temperature at which its structural shrinkage is a maximum. In the case of the abovementioned alloy, this temperature lies between 200 and 300° C. As the dimensions of the sizing gage 8 are greater, the part shrinks onto this gage and adopts the shape thereof. When the temperature continues to drop, the part expands again and thus separates from the annulus formed by the sizing gage 8. A clearance "e" forms; this is depicted in FIG. 5. When the temperatures are stabilized, the assembly is removed from the tempering vessel and the part is removed from the support.

A more elaborate embodiment of the method allowing precise adjustment of the sizing gage relative to the part is now described.

Figure 10:
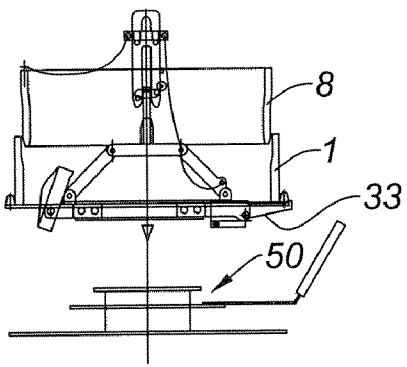
Figure 6:
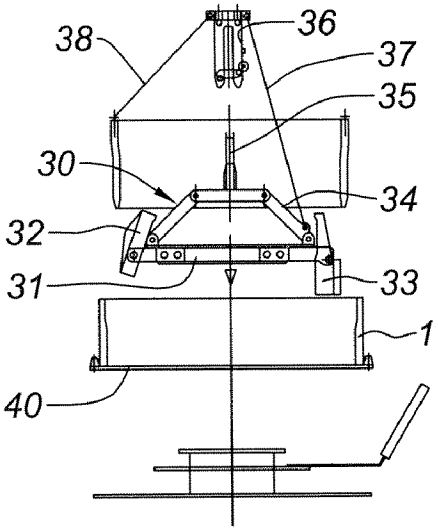
Figure 9:
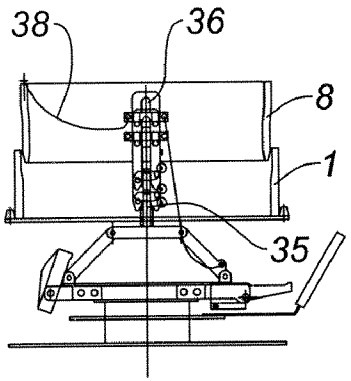
Figure 8:
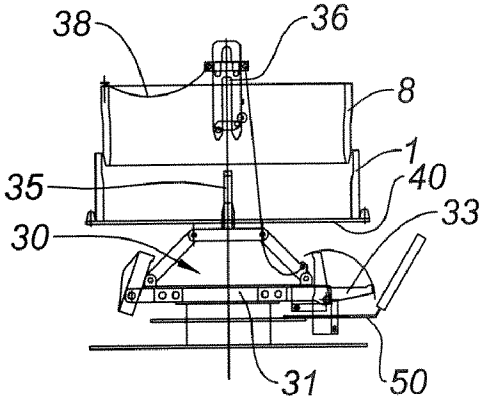
Figure 11:
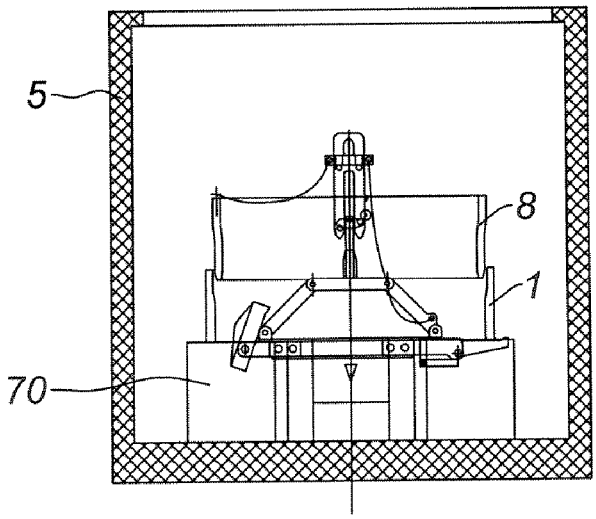
Figure 12:
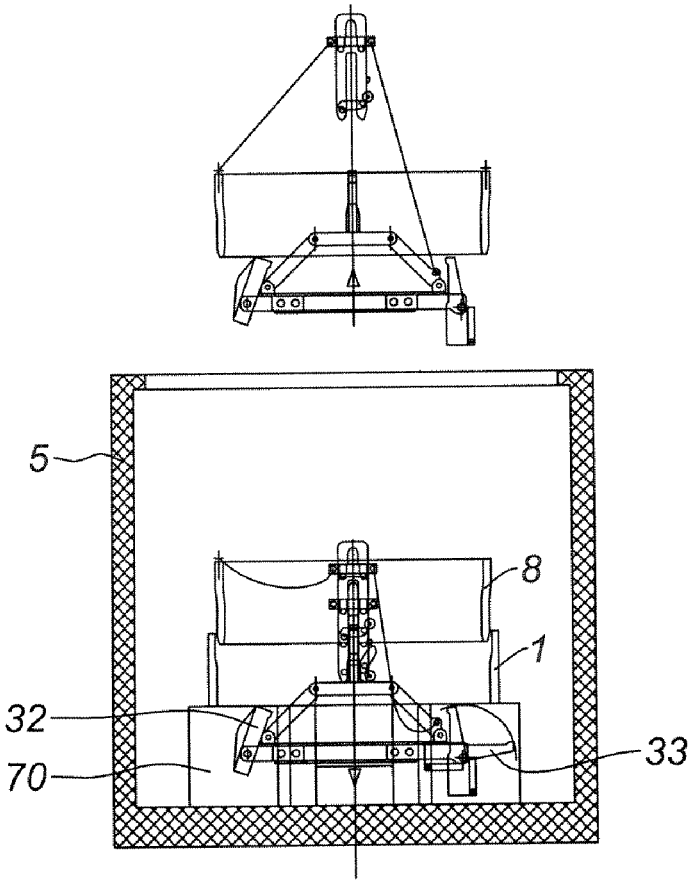

Here, use is made of a support or dummy bar 30 made up of a lower frame 31 equipped with articulated first radial arms 32 and second radial arms 33 articulated about horizontal axes. These radial arms will, each in turn, serve to support the part during handling operations. The arms 32 are depicted raised upward in FIG. 6. The arms 33 are weighted in such a way that when unloaded they stand vertically as can be seen in FIG. 6. The dummy bar 30 comprises means 34 for the suspension of the frame 31. The means 34 themselves comprise a central vertical rod 35 which, as will be seen later, comes into engagement with a catching means 36 in the form of a gripper. In the configuration of FIG. 6, the frame 31 is kept suspended by cables 37, just one of which has been depicted, from the upper part of the catching gripper 36. The annulus of the sizing gage 8 is also suspended, in this preparatory phase, from the upper part of the gripper by cables 38 or other equivalent means just one of which has been depicted. The part 1 rests on an annular bed 40 and the assembly formed by the rod 35, the sizing gage 8 and the gripper is coaxial with the part. The assembly is lowered vertically. As the radial arms 32 and 33 are raised, the frame 31 can be lowered lower than the bed 40. The sizing gage 8 then comes to bear against the upper edge of the part. The dimensions have been tailored such that the sizing gage is retained by the edge of the part 1 at ambient temperature. When the position is that of FIG. 8, the radial arms 33 are pivoted; the frame 31 rests on a rest 50. The gripper 36 is lowered until it comes into engagement with the rod 35 as can be seen in FIG. 9. The assembly is then raised vertically. This movement causes the part with the bed 40 to be carried along by the radial arms 33, FIG. 10. The assembly is set down in the heat treatment furnace 5, on a rest 70, FIG. 11. The rest 70 allows the frame 31 to be lowered below the level of the part 1. The arms 33 can then be brought into a vertical position and the support assembly 30 raised again with the sizing gage 8 suspended by the cables 38, leaving the part 1 by itself resting on the rest 70, FIG. 13. The furnace is closed with its bell 51 and heat treatment is performed. It can be seen that the dummy bar 30 has been raised vertically with no handling operation other than the lowering of the radial arms 32 and the disengagement of the gripper 36 from the rod 35, FIG. 13.

Figures 13, 14, 15:
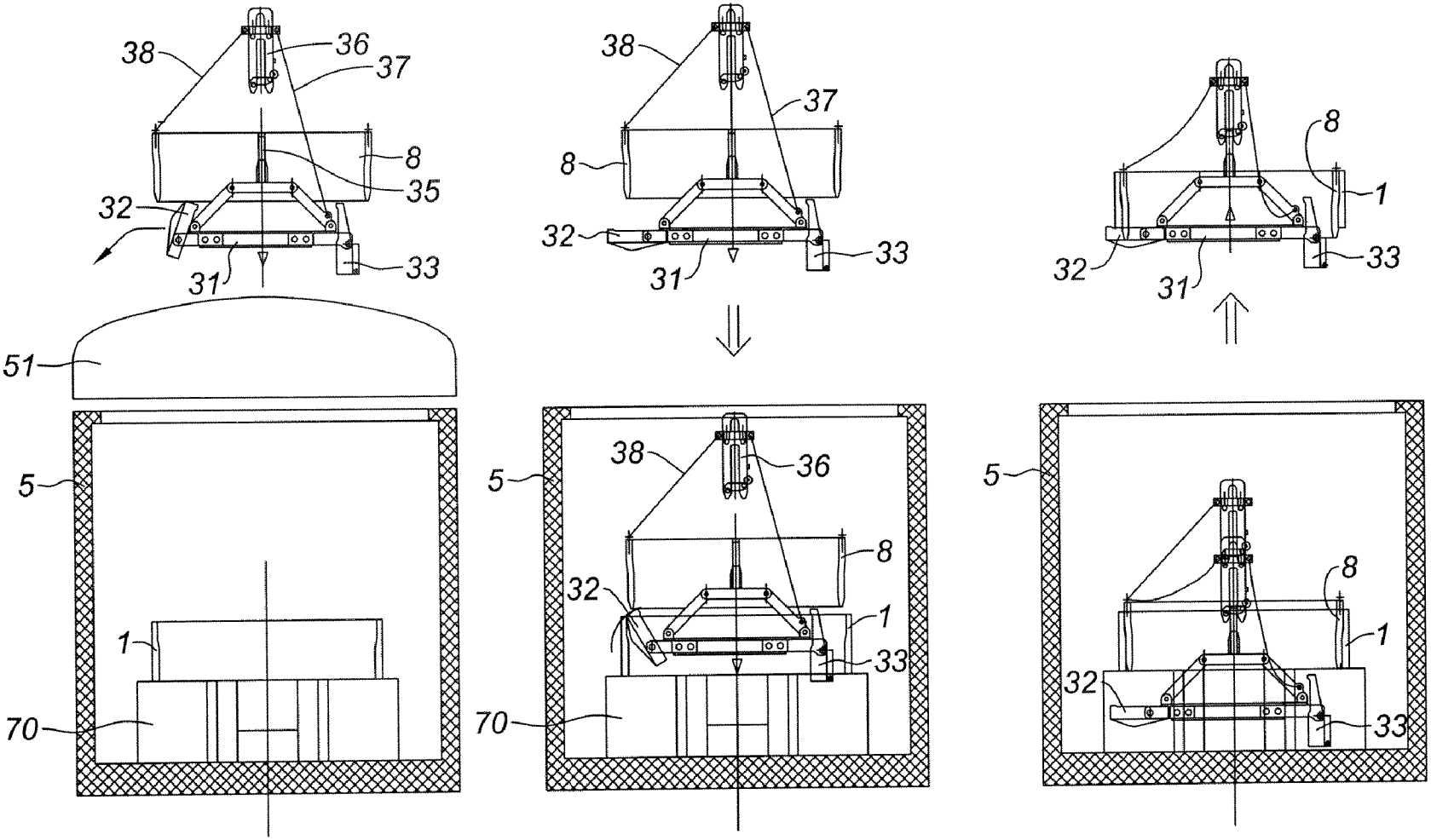
Figure 16:
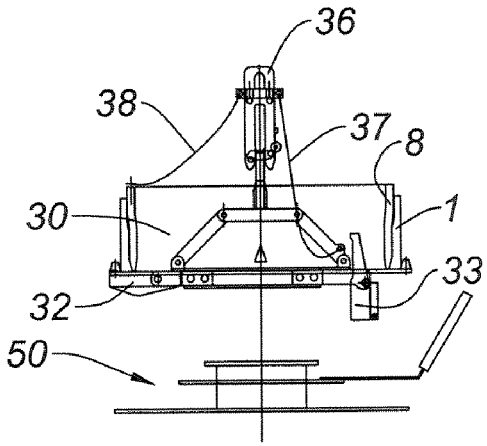
Figure 17:
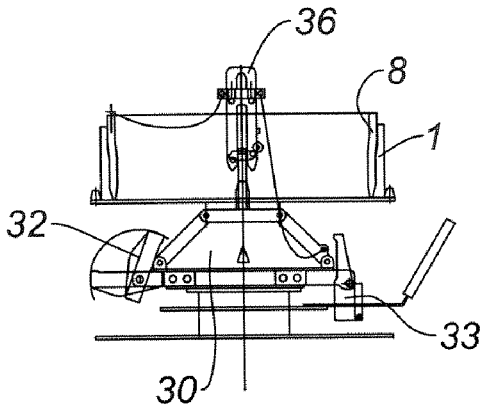
Figure 18:
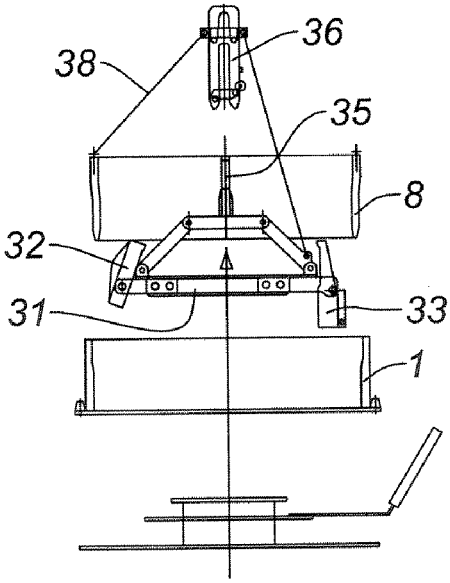

Once the heat treatment has been completed, the furnace is opened and the dummy bar 30 is lowered, FIG. 14. The radial arms slide along the part 1, FIG. 14. Because the part 1 is in the expanded state, the sizing gage 8 enters its bore when the dummy bar is lowered below the bed supporting the part. The arms 32 are then deployed and engage under the part when the dummy bar 30 is lifted up again, FIG. 15. Thus, the assembly comprising the part 1 equipped with its sizing gage 8 is carried to the tempering vessel not depicted here. After tempering, the assembly is set down on a resting bench 50 so that the sizing gage can be removed, FIG. 16. The dummy bar 30 is lowered below the resting bench 50 so as to allow the radial arms 32 to stand up, FIG. 17. The catching gripper 36 is detached from the rod 35 and the dummy bar 30 is raised. The gripper 36 then carries the sizing gage 8 via the cables 38 and the frame 31 via the cables 37. Finally, the sized part 1 is carried away to any other treatments it may require.

The configuration of the dummy bar according to the latter embodiment offers the advantage of ensuring correct positioning and centering of the sizing tool 8 relative to the part 1 throughout all the phases of the process without having to act specifically on the tool 8. This solution is advantageous by comparison with the first where the sizing tool has to be fitted while the part is still in the furnace and at the heat treatment temperature.

The invention claimed is:

1. A method of sizing a cylindrical part following shaping, by plastic deformation, of a metallic material that has maximum structural shrinkage at a maximum-shrinkage temperature between a first temperature and a second temperature which is lower than the first temperature, the method comprising:

placing the part in a shaft furnace;

positioning an internal-sizing apparatus outside the furnace and in line with the part, the internal-sizing apparatus includes an internal-sizing tool with an outer diameter which is greater than an inner diameter of the part at maximum structural shrinkage;

heating the part to the first temperature;

lowering and fitting the internal-sizing tool into the part;

transporting the assembly formed by the part and the internal-sizing tool to a tempering vessel;

cooling the part to a temperature below said second temperature; and extracting the internal-sizing tool.

2. The method as claimed in claim 1, wherein the part is placed in a furnace and heated to the first heat treatment temperature; after treatment, said sizing tool is placed on the part and the assembly is positioned in a tempering tub; the part is cooled to said lower temperature.

3. The method as claimed in claim 1, wherein the metal is a Z5CNU17 alloy.

4. The method according to claim 1, wherein the internal-sizing apparatus includes:

a dummy bar attached to a frame;

first and second articulated radial arms attached to the frame at first and second ends of the frame, respectively, which radial arms support the part; and a catching gripper which attaches to the dummy bar, and wherein the internal-sizing tool is suspended from the catching gripper by cables.

5. The method as claimed in claim 4, wherein the catching gripper is movable between a first position where the catching gripper is secured by a rod to the dummy bar and a second position where the dummy bar is suspended from the catching gripper by cables.

6. The method according to claim 1, wherein the part is a turbomachine casing.

7. The method according to claim 1, wherein the first temperature is 1000° C., the second temperature is ambient temperature, and the maximum-shrinkage temperature is between 200° C. and 300° C.

* * * * *